United States Patent [19]

Aranzabal

[11] Patent Number: 4,815,992

[45] Date of Patent: Mar. 28, 1989

[54] DEVICE FOR JOINING SWITCHES TO SUPPORT BASES FOR IRONS

[75] Inventor: Luis Z. Aranzabal, Eibar Guipuzcoa, Spain

[73] Assignee: Oficina De Investigacion Agrupada, S.A., Matxaria, Spain

[21] Appl. No.: 62,718

[22] Filed: Jun. 15, 1987

[30] Foreign Application Priority Data

Jun. 25, 1986 [ES] Spain ..... 295282

[51] Int. Cl.[4] ..... D06F 75/28

[52] U.S. Cl. ..... 439/620; 219/247; 248/117.2; 439/919; 200/51.09

[58] Field of Search ..... 38/75, 82; 219/246, 219/247, 256, 257; 439/620, 894, 919; 248/117.1, 117.2, 117.3, 117.4, 117.5, 117.6, 117.7; 200/51.09, 153 LB

[56] References Cited

U.S. PATENT DOCUMENTS 1,606,829 11/1926 Evans ..... 219/247

1,966,263 7/1934 Roller ..... 219/247

*Primary Examiner*—Gil Weidenfeld

*Assistant Examiner*—Gary F. Paumen

*Attorney, Agent, or Firm*—Helfgott & Karas

[57] ABSTRACT

A combination of a base and an electrical connector switch which can be removably disposed in the base. The switch is adapted to be removably disposed in a conforming rear recess in an electric iron so that when the switch is disposed in the base and is electrically connected to a source of electric power, the iron can be supported on the base with the switch engaging the recess to charge the iron.

3 Claims, 2 Drawing Sheets

DEVICE FOR JOINING SWITCHES TO SUPPORT BASES FOR IRONS

FIELD OF THE INVENTION

Current various devices are known which offer the possibility, with the same electric iron, of being able to choose between ironing with an electric power line or cable directly connected to the iron in the traditional manner, or with the iron being disconnected from the cable in the ironing operation, in which case the iron has been previously heated by receiving energy from a support base or fixed bracket, which is connected directly to the electric power line. The iron is then disconnected from the base or bracket before use.

These devices generally include a plug (connector), connected to the electric power line and which in turn is connected directly to the iron or to the fixed bracket.

This invention relates to a connecting device which enables the plug or connector to be coupled advantageously to the fixed bracket and to the iron.

THE STATE OF PRIOR ART

In the field of this invention, devices are known in which the connector is hooked up at two sides to respective outer flanges built into the support base of the iron. This device has the main disadvantage that the connection is somewhat precarious since the flanges break easily, due to the joint provided in the rear part of the iron, which can be easily damaged when the iron is tilted or tipped, when it is in the upright position on the support base; and this tilting can be produced extremely easily by unintentionally knocking the iron and occurs constantly in normal use.

Other devices known in this field adopt configurations which are sometimes quite complex, specifically in the rear part of the moulded housing of the iron, consisting of hooking devices for sliding hooks of the connector or bosses into the projections of the said connector. The special configurations involved in these devices entail manufacturing complications and to a great extent place conditions on each iron and each bracket to each connector, which makes the product less flexible for adapting it to future modifications and improvements in the connector and/or in the bracket.

EXPLANATION OF THE INVENTION AND ITS ADVANTAGES

This invention is directed toward the combination of a base and an electrical connector switch which can be removably disposed in the base, said switch being adapted to be removably disposed in a conforming rear recess in an electric iron whereby when the switch is disposed in the base and is electrically connected to a source of electric power, the iron can be supported on the base with the switch engaging the recess to charge the iron.

The base in plan view has the shape of a U with an elongated member being connected to adjacent ends of spaced apart arms which diverge outward from the member to oppositely disposed free ends, the adjacent inner surfaces of the arms having aligned grooves or channel moulding which extend from the free ends to the member. The base further includes a flat flexible plate which is disposed underneath the arms and extends from the member to a position disposed between the ends of the arms and adjacent the free ends, said member having an upwardly extending boss disposed at said position and spaced from both arms.

The switch has a body which in plan view is somewhat smaller in shape and size but essentially conforms to the area defined by said plate, said body having outwardly extending flanges adapted to detachably engage said grooves when the switch is engaged in said base, said body having a front end which contacts the member and a rear end which is in contact with said boss to detachably lock the switch in place in the base when the switch is so engaged.

The term "switch" is used in the specification in connection with the connector or plug would correspond, due to the fact that in this case this element does not produce an electric connection until a degree of penetration of the plug is reached which drives an internal mechanism producing the contact, hence said element acts more as a switch than a simple connector.

Another feature of the invention consists in that near the flange, the ends of a telescopic cross shaft protrude sideways from the body of the switch, against a spring supported in both inner arms which end in right-angled points, which like pawls, jut out sideways at another level, acting as safety hooking pawls; this layout enables the sliding of the flange in the channel moulding of the base to produce the stop of the cross shaft ends against the inner walls of the base, pushing them into the switch body, with the consequent simultaneous retraction of the hooking pawls.

According to the invention, a bridge is provided in the support base, which bridge links the diverging "U" shaped arms and is designed so that the bottom of the iron rests on it, the dimension of the surface of this bridge and the prolonged divergence of the arms being sufficient to allow the switch body to pass in the opposite direction, to be placed opposite the channel moulding in a lengthwise direction, which culminates in the switch coupling to the support base.

The main advantages of the invention reside in its constructive and operative simplicity which ensure the coupling between the switch and the base by configurations as simple as a combined flange and channel moulding, which simply slide and fit together. On the other hand, the firmness and immobility of this fit is achieved due to the great adaptation length between the flange and the channel moulding and on the other hand, due to the side pressure caused by the ends against the spring of the telescopic cross shaft; and finally due to, the projecting boss which keeps the switch in its coupled position. At the same time, to release the coupling, it is only necessary to lightly press the semicircular elongation, with a slight reciprocating movement reverse to that of the coupling operation.

Regarding coupling the switch to the iron, on the one hand, the device has the advantage that all that is needed in the back of the iron are two grooves to allow the hooking pawls to be housed, and consequently the latter do not need to have any special configuration. This connection is a simple operation, as it suffices to press the cross shaft ends, offering great security due to the very nature of the hook-up and to the fact that the retraction of the shaft ends is independent; this enables the dimensional differences of the side fitting to be compensated, thus ensuring that the hook-up is correct on each side, even in the event that the other side has not been closed properly.

BRIEF DESCRIPTION OF THE DRAWINGS

To understand the nature of the invention better, in the attached drawings, a preferred form of industrial embodiment is shown, which is merely an illustrative and unlimiting example.

DETAILED DESCRIPTION OF THE PREFERRED EMBODIMENT

The figures outlined illustrate a preferred embodiment of the invention, comprising a support base (1), a switch (2) and a telescopic cross shaft (3) installed in the latter.

Figure 1:
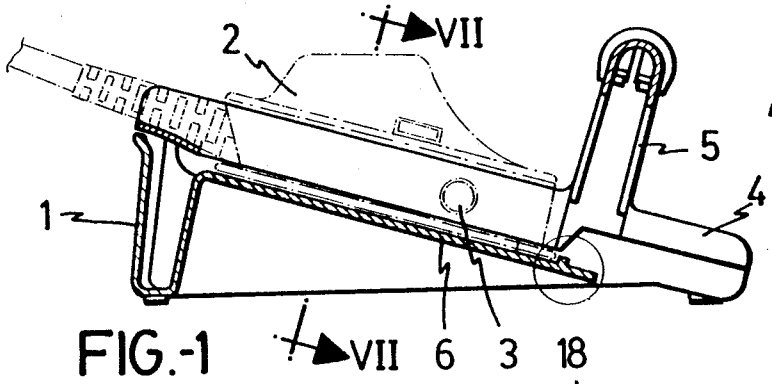
FIG. 1 is a side view illustrating the longitudinal section of the support base (1) indicated by the line I—I of FIG. 4. On it, the silhouette of the switch (2) is indicated in a dotted line, in its operative coupling position.
Figure 2:
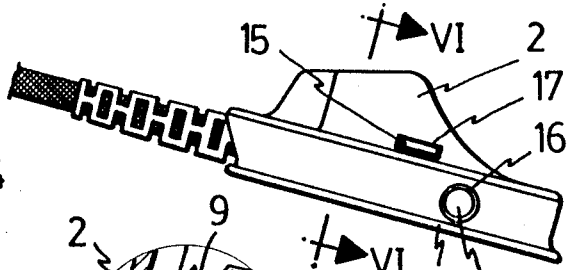
FIG. 2 is a side view illustrating the switch (2) with a degree of inclination similar to that of its coupling on the support base (1).
Figure 3:
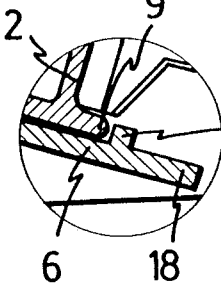
FIG. 3 is an enlarged view of the detail circled in FIG. 1 of the projecting boss (7).
Figure 4:
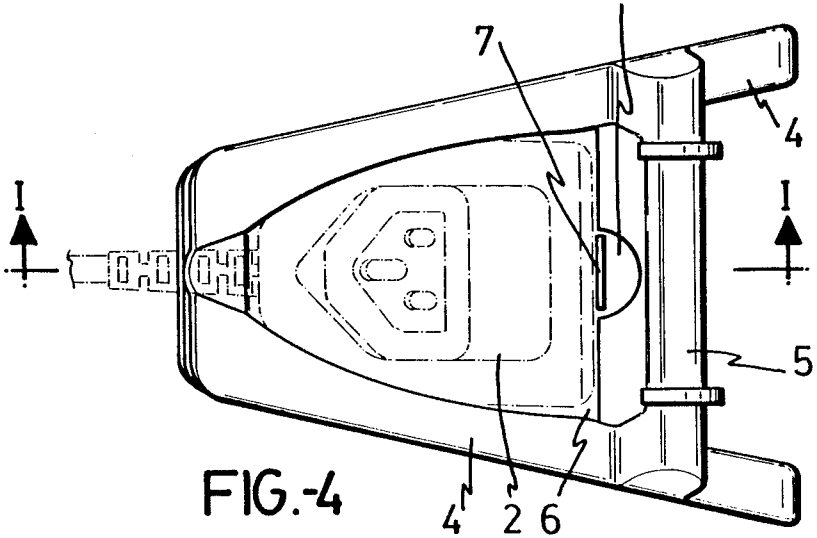
FIGS. 4 and 5 are respective plan views corresponding to FIGS. 1 and 2, but with the particularity that the projection concerning FIG. 5 has been made considering that the switch (2) is resting horizontally.
Figure 5:
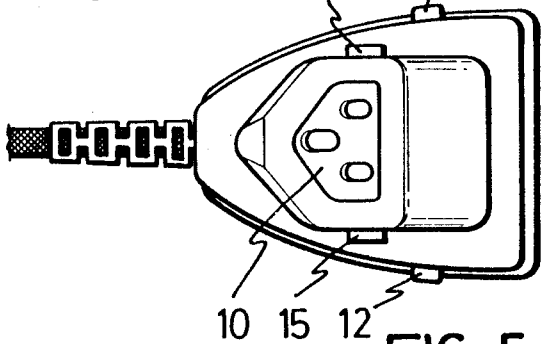

The support base (1) comprises basically (FIGS. 1, 4, 7 and 9), in its plan view, a "U" shaped body, whose converging arms (4) are linked near the free end through a bridge (5) which has a higher span than the switch (2) and which is designed to act as a support for the bottom of the iron. Between the bridge (5) and the bottom of the "U", the arms (4) are linked underneath by a cross-piece (6) (FIG. 1) producing the joint, so that above this crosspiece (6) in each arm two channel mouldings (8) are defined, which continue along the bottom of the "U" shape, this crosspiece (6) having in its free end a projecting boss (7) intended to hold the switch (2) on the support base (1) in a coupled position (FIG. 3). The inclination of the crosspiece (6) and of the plane of the bridge (5) have been studied ergonomically according to the way the operations of removing and placing the iron are actually performed, during cable-free ironing.

On the other hand, the switch (2) has in its base (FIGS. 2, 5, 6, 7 and 8) a flange (9), so that when the switch (2) is coupled to the support base (1) (FIGS. 1, 4, 7 and 8), the broad side lengths of the flange (9) fit under moulding (8), at the same time as the larger front edge is gripped in the projecting boss (7) of the crosspiece (6). Inside the switch body a compact electric unit (10) is installed, which incorporates the switch contacts, and is provided with holes to receive a connecting plug element.

The telescopic cross shaft (3) consits of a shaft (11) on which two end bushings (12) are installed telescopically, with a converging chamfered end towards the front part of the switch, and also an intermediate compression spring (13) which acts between both inner arms (14) at right angles to and integral with the bushings (12) and which are terminated in some hooking pawls (15). The telescopic cross shaft (3) is installed operatively in the switch (2) so that its two end bushings (12) protrude sideways through two circular windows (16) at the same time as their respective hooking pawls (15) jut out through two elongated windows (17); the ends of the bushings (12) protrude at a level which in the coupled position to the support base (1) are opposite to the side of the arms (4), whereas the pawls (15) jut out above the said arms (4) in the right position to hook up at the back of the iron.

Figure 6:
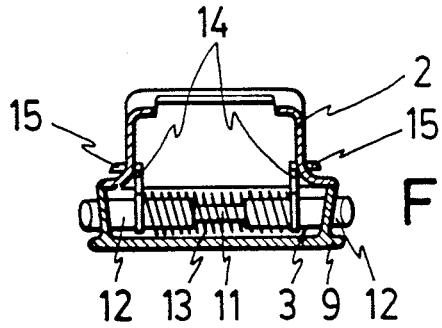
FIG. 6 is a cross-section of the switch (2) taken according to the line VI—VI of FIG. 2.
Figure 7:
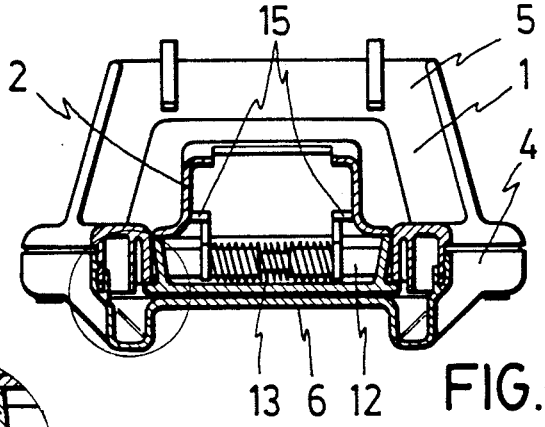
FIG. 7 is a cross-section view of the support base (1) taken according to line VII—VII of FIG. 1 and considering that the switch (2) is coupled to it.
Figure 8:
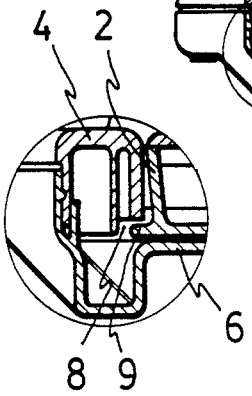
FIG. 8 is an enlarged view of the detail circled in FIG. 7 showing the penetration of the flange (9) in the channel moulding (8).
Figure 9:
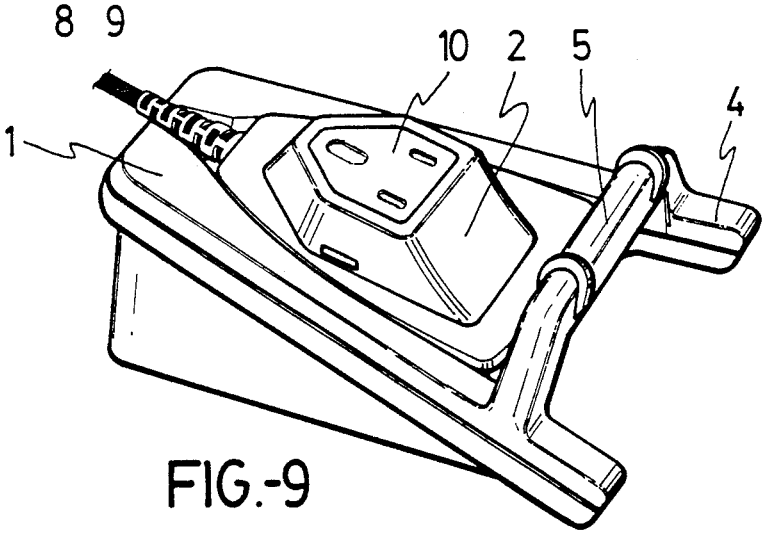
FIG. 9 is a perspective view showing the switch (2) coupled to the support base (1).

With the layout disclosed, the coupling operation of the switch (2) in the support base (1) is performed, ensuring that the farmer makes a reciprocating movement passing under the bridge (5), first towards the ends of the arms (4) until the flange (9) is placed in the channel moulding (8) and then moves in the opposite direction until the projecting boss (7) is passed, thereby achieving the fit required; this fit assists the retraction of the pawls (15) in their windows (17) due to the compression which the inner walls of the arms (4) exert on the chamfered ends of the bushings (12) and which help to immobilize the coupling when in normal use; on the other hand, the retraction of the pawls (15) means that they offer no obstacle whatsoever in connecting and disconnecting the iron in this form of the cable-free ironing. FIGS. 6 and 7 enable the two situations to be seen clearly with the pawls (15) protruding and the spring (13) extended and the pawls (15) retracted and the spring (13) compressed.

To undo the coupling, it suffices to press a semicircular enlongation (18) of the edge of the crosspiece (6) so that the actual flexibility of the latter releases the retention exerted by the projecting boss (7) and the reciprocating operation can be performed, contrary to the coupling operation.

Once the switch (2) has been separated from the base, the hooking pawls (15) and the ends of the bushings (12) will protrude again (FIG. 6) and the switch (2) can be coupled to the back of the iron, retracting and releasing the pawsl (15) manually, which enables ironing with the cable; the independent telescopic action of the end bushings enables dimensional differences to be compensated, guaranteeing at all times that the pawls (15) are correctly hooked into the grooves of the back of the iron, for even though one of the pawls (15) does not go right into its groove, this does not affect the other performing its interlocking function.

We claim:

1. The combination of a base and an electrical connector switch which can be removably disposed in the base, said switch being adapted to be removably disposed in a conforming rear recess in an electric iron whereby when the switch is disposed in the base and is electrically connected to a source of electric power, the iron can be supported on the base with the switch engaging the recess to charge the iron wherein said base in plan view has the shape of a U with an elongated member being connected to adjacent ends of spaced apart arms which diverge outward from the member to oppositely disposed free ends, the adjacent inner surfaces of the arms having aligned grooves which extend from the free ends to the member, said base further including a flat flexible plate which is disposed underneath the arms and extends from the member to a position disposed between the ends of the arms and adjacent the free ends, said member having an upwardly extending boss disposed at said position and spaced from both arms; and said switch has a body which in plan view is somewhat smaller in shape and size but essentially conforms to the area defined by said plate, said body having outwardly extending flanges adapted to detachably engage said grooves when the switch is engaged in said base, said body having a front end which contracts the member and a rear end which is in contact with said base to detachably lock the switch in place in the base when the switch is so engaged.

2. The combination of claim 1 further including an additional member essentially parallel to the elongated member which is disposed above the arms in a position between the boss and the free ends of the arms and is secured at each end to a corresponding arm, there being sufficient clearance between the additional member and the base to enable the switch to be removably disposed in the base, the additional member and base cooperating to support the iron.

3. The combination of claim 2 further including manually operable pawl means carried by the switch for detachably engaging the switch and the iron.

* * * * *